US011581107B2

(12) United States Patent
He

(10) Patent No.: US 11,581,107 B2
(45) Date of Patent: Feb. 14, 2023

(54) FLAT CABLE AND WIFI CONNECTION LINE

(71) Applicant: SHENZHEN TCL NEW TECHNOLOGY CO., LTD., Guangdong (CN)

(72) Inventor: Shunliang He, Shenzhen (CN)

(73) Assignee: Shenzhen TCL New Technology Co., Ltd., Shenzhen (CN)

( * ) Notice: Subject to any disclaimer, the term of this patent is extended or adjusted under 35 U.S.C. 154(b) by 83 days.

(21) Appl. No.: 17/253,739

(22) PCT Filed: Mar. 11, 2020

(86) PCT No.: PCT/CN2020/078830

§ 371 (c)(1),
(2) Date: Dec. 18, 2020

(87) PCT Pub. No.: WO2020/244270

PCT Pub. Date: Dec. 10, 2020

(65) Prior Publication Data

US 2021/0265080 A1 Aug. 26, 2021

(30) Foreign Application Priority Data

Jun. 3, 2019 (CN) ..... 201920840826.7

(51) Int. Cl.
*H01B 7/08* (2006.01)
*H01R 12/71* (2011.01)

(52) U.S. Cl.
CPC ..... *H01B 7/0823* (2013.01); *H01R 12/71* (2013.01); *H01R 2201/04* (2013.01)

(58) Field of Classification Search
CPC .. H01B 7/0861; H01B 7/0009; H01B 7/0838; H01B 7/0823; H01B 7/0876;
(Continued)

(56) References Cited

U.S. PATENT DOCUMENTS 4,285,561 A * 8/1981 Chow ..... H01R 12/68 439/422
5,057,646 A * 10/1991 Nichols ..... H01B 7/0861 174/115
(Continued)

FOREIGN PATENT DOCUMENTS

CN 105283929 A 1/2016
CN 108648858 A 10/2018
(Continued)

OTHER PUBLICATIONS

International Search Report, dated May 28, 2020, for Shenzhen TCL New Technology Co., Ltd., International Application No. PCT/CN2020/078830, filed Mar. 11, 2020.
(Continued)

*Primary Examiner* — Gary F Paumen
(74) *Attorney, Agent, or Firm* — Nathan & Associates; Menachem Nathan

(57) ABSTRACT

Disclosed are a flat cable and a WIFI connection line, where the flat cable includes flat wires and an insulation layer wrapped around the flat wires. The flat wires include one power line, four signal lines and two ground lines arranged at intervals, and a width of the power line and a width of each ground line are both greater than a width of each signal line.

13 Claims, 1 Drawing Sheet

(58) Field of Classification Search
CPC ..... H01B 9/003; H01B 9/02; H01B 11/08; H01B 11/04; H01B 11/10; H01B 11/00; H01B 11/002; H01B 11/203; H05K 1/0218; H05K 1/028; H05K 2201/0723; H05K 2201/09236; H01R 13/6581; H01R 13/5845; H01R 9/0515; H01R 12/598; H01R 12/71; H01R 2201/04; H04W 4/70; H04W 24/04; H04W 84/18; G08B 25/004; H04L 41/28; H04L 43/0811; H04L 43/0817
USPC ..... 174/117 F, 102 R, 115
See application file for complete search history.

(56) References Cited

U.S. PATENT DOCUMENTS 6,645,002 B1 * 11/2003 Lee ..... H01R 4/2429 439/497
10,737,342 B2 * 8/2020 Wu ..... H01R 12/778
10,804,008 B2 * 10/2020 Lin ..... H01B 7/0861
2004/0182595 A1 * 9/2004 Halter ..... H01B 7/0823 257/E25.02
2012/0181075 A1 * 7/2012 Su ..... H01R 12/62 228/180.22
2013/0341072 A1 * 12/2013 Lin ..... H05K 1/148 174/254
2018/0068761 A1 * 3/2018 Chin ..... H01R 12/777
2021/0166836 A1 * 6/2021 Nagano ..... H01B 7/0838

FOREIGN PATENT DOCUMENTS

CN 109273933 A 1/2019
CN 209657844 U 11/2019
DE 202005015154 U1 2/2006

OTHER PUBLICATIONS

Written Opinion of the International Search Authority, dated May 28, 2020, for Shenzhen TCL New Technology Co., Ltd., International Application No. PCT/CN2020/078830, filed Mar. 11, 2020.

* cited by examiner

FLAT CABLE AND WIFI CONNECTION LINE

CROSS REFERENCE TO RELATED APPLICATIONS

This application is the National Stage of International Application No. PCT/CN2020/078830, filed on Mar. 11, 2020, which claims the priority of Chinese patent application filed in the National Intellectual Property Administration, PRC on Jun. 3, 2019, with the application number 201920840826.7 and title "Flat Cable and WIFI Connection Line", the entire contents of which are hereby incorporated by reference.

TECHNICAL FIELD

This application relates to the field of signal transmission lines, in particular to a flat cable and a WIFI connection line.

BACKGROUND

With the rapid development of wireless network technology, smart TVs with WIFI receiving function are rapidly popularized and have almost become the standard configuration of smart TVs. In a smart TV, in order to reduce the mutual interference between the WIFI circuit and the circuit on the TV motherboard, the WIFI circuit is generally made into an independent functional module, and then placed in a location away from the TV motherboard. The TV main board and the WIFI module are connected through a WIFI connection line. The WIFI connection line has two functions: first, it transmits high-speed USB data signals; second, the core board may be used to supply power to the WIFI module through the WIFI connection line.

The existing WIFI connection line is made of flat copper wire cable. In actual use, as the length of the wire increases, the voltage drop between the power line and the ground line continues to increase, and when the length exceeds a certain value, it is easy to cause WIFI connection problems.

Therefore, it is necessary to provide a new flat cable and WIFI connection line to solve the above technical problems.

SUMMARY

The main object of this application is to provide a flat cable and a WIFI connection line, which aims to solve the WIFI connection problem caused by the large voltage drop on the power line of the existing WIFI connection line.

In order to achieve the above object, this application provides a flat cable, which includes flat wires and an insulation layer wrapped around the flat wires, where the flat wires include one power line, four signal lines and two ground lines arranged at intervals, and a width of the power line and a width of each ground line are both greater than a width of each signal line.

Optionally, the power line is arranged in a center, and two of the signal lines and one of the ground line are sequentially arranged along a direction from the power line to two edges of the flat cable.

Optionally, the width of the power line is same as the width of each ground line and is 1.3 mm.

Optionally, the width of each signal line is 0.3 mm.

Optionally, an interval between any two adjacent flat wires is equal.

Optionally, a length of the flat cable is less than 1.5 meters.

In addition, this application further provides a WIFI connection line, which includes the flat cable as described above.

Optionally, one end of the flat cable is provided with a first connector configured to be connected to a TV motherboard, and the other end of the flat cable is provided with a second connector configured to be connected to a WIFI module; the first connector is provided with first connection terminals, and the second connector is provided with second connection terminals, where the first connection terminals and the second connection terminals are arranged in a one-to-one correspondence and conducted through corresponding flat wires.

Optionally, the second connection terminals are arranged corresponding to the flat wires, and the second connection terminals are respectively a first ground terminal, a second ground terminal, a first power terminal, a second power terminal, a third power terminal, a first signal terminal, a second signal terminal, a first control terminal, and a second control terminal; and the power line is shared by the first power terminal, the second power terminal and the third power terminal.

Optionally, the first ground terminal, the first signal terminal, the first control terminal, the first power terminal, the second power terminal, the third power terminal, the second control terminal, the second signal terminal, and the second ground terminal are sequentially arranged at intervals along a width direction of the second connector.

In the solution of this application, the signal line is configured to transmit control signals, the power line is configured to transmit power, and the ground line is configured to ground to ensure electrical safety. By increasing the widths of the power line and the ground line, the cross-sectional areas of the power line and the ground line are increased, so that the voltage drop on the power line may be reduced to a certain extent, thereby increasing the effective connection length of the flat cable, and broadening the application range of the flat cable. The flat wires may be applied in the WIFI connection line to realize the transmission of power and control signal between the TV motherboard and the WIFI module.

BRIEF DESCRIPTION OF THE DRAWINGS

In order to more clearly describe the technical solutions in the embodiments of this application or the prior art, the following will briefly introduce the drawings that need to be used in the description of the embodiments or the prior art. Obviously, the drawings in the following description are only some embodiments of this application. For those of ordinary skill in the art, without creative work, other drawings can be obtained according to the structures shown in these drawings.

Figure 1:
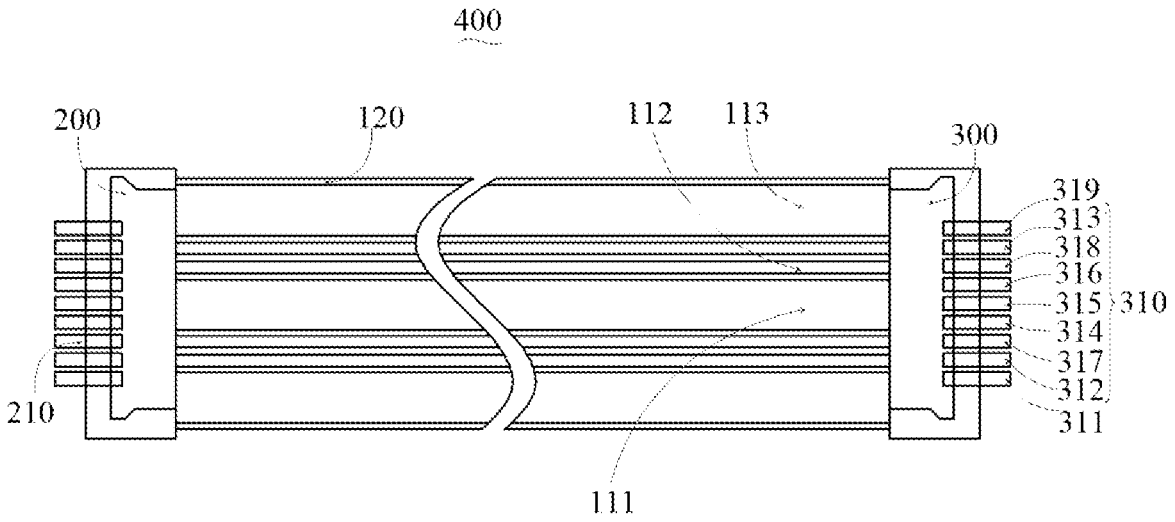
FIG. 1 is a schematic structural diagram of a WIFI connection line according to an embodiment of this application.

The realization, functional characteristics, and advantages of the purpose of this application will be further described in conjunction with the embodiments and with reference to the accompanying drawings.

DETAILED DESCRIPTION OF THE EMBODIMENTS

The technical solutions in the embodiments of this application will be described clearly and completely in conjunction with the drawings in the embodiments of this application. Obviously, the described embodiments are only a part of the embodiments of this application, but not all the embodiments. Based on the embodiments in this application, all other embodiments obtained by those of ordinary skill in the art without creative work shall fall within the protection scope of this application.

It should be noted that all directional indicators (such as up, down, left, right, front, back . . . ) in the embodiments of this application are only used to explain the relative positional relationship, movement conditions, etc. among the components in a specific posture (as shown in the drawings), if the specific posture changes, the directional indicator also changes accordingly.

In addition, the descriptions related to "first", "second", etc. in this application are for descriptive purposes only, and cannot be understood as indicating or implying their relative importance or implicitly indicating the number of indicated technical features. Thus, the features defined as "first" and "second" may include at least one of the features either explicitly or implicitly. In the description of this application, the meaning of "plurality" is at least two, such as two, three, etc., unless specifically defined otherwise.

In this application, unless otherwise clearly specified and limited, the terms "connected", "fixed", etc. should be understood in a broad sense. For example, "fixed" can be a fixed connection, a detachable connection, or a whole; it can be a mechanical connection or an electrical connection; it can be a direct connection or an indirect connection through an intermediate medium, and it can be the internal communication between two components or the interaction relationship between two components, unless specifically defined otherwise. For those of ordinary skill in the art, the specific meanings of the above-mentioned terms in this application can be understood according to specific circumstances.

In addition, the technical solutions between the various embodiments of this application can be combined with each other, but they must be based on the ability of those skilled in the art to realize. When the combination of technical solutions conflicts with each other or cannot be realized, it should be considered that the combination of such technical solutions does not exist, nor within the scope of protection required by this application.

Figure 2:
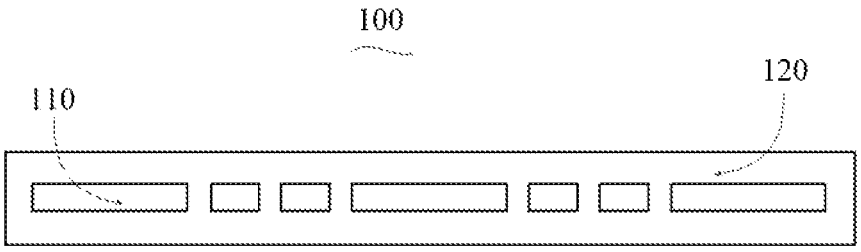
FIG. 2 is a schematic structural diagram of a flat cable according to an embodiment of this application.

As shown in FIGS. 1 and 2, in an embodiment of this application, the flat cable 100 includes flat wires 110 and an insulation layer 120 wrapped around the flat wires 110. The flat wires 110 include one power line 111, four signal lines 112 and two ground lines 113 arranged at intervals, and a width of the power line 111 and a width of each ground line 113 are both greater than a width of each signal line 112. The ground line 113 is configured to connect a ground line of the power supply, the power line 111 is configured for power supply transmission, and the four signal lines 112 are configured for signal transmission. Because the cross-sectional areas of the power line 111 and the ground line 113 have been greatly increased compared to before, under the same conditions, the voltage drop on the power line 111 and the ground line will not drop too much, so that the effective connection length of the WIFI connection line 400 may be increased, thereby broadening the application range of the flat cable 100.

The flat wire 110 is preferably an extremely thin tin-plated flat copper wire. The insulation layer 120 is preferably a layer of PET (polyester resin) insulating material covering the periphery of the tin-plated flat copper wires. In this way, the flat cable 100 manufactured thereby has the advantages of softness, free bending and folding, thin thickness, small size, simple connection, convenient disassembly, and easy to solve electromagnetic shielding (EMI). After the modules are connected through the flat cable 100, the flat cable 100 may be glued to a reinforcing plate to realize the fixation of the flat cable 100 and ensure the stability and safety of the connection.

The power line 111 is arranged in a center, and two signal lines 112 and one ground line 113 are sequentially arranged along a direction from the power line 111 to two edges of the flat cable 100. That is, on the flat cable 100, the arrangement sequence of the flat wires 110 along the width direction of the flat cable 100 is one ground line 113, two signal lines 112, one power line 111, two signal lines 112, and one ground line 113. The signal lines 112 and the ground lines 113 are arranged symmetrically with the power line 111 as the center of symmetry, so that the flat cable 100 has no directionality. The direction of the flat cable 100 does not need to be considered when it is connected to external modules, no matter which end of the flat cable 100 is inserted into the corresponding socket, the connection relationship is the same, and there is no need to consider the problem of direction.

In a preferred embodiment, the width of the power line 111 is the same as the width of each ground line 113 and is 1.3 mm. The length of the signal line 112 is preferably 0.3 mm. The specifications of the power line 111 and the ground line 113 are preferably 1.3 mm in width and 0.05 mm in thickness, and the specifications of the signal line 112 are preferably 0.3 mm in width and 0.05 mm in thickness, thereby ensuring that only two types of flat wires 110 are used in the processing and manufacturing of the entire flat cable 100. And controlling the specifications and types of raw materials may avoid mixing problems during processing, thereby improving the yield rate of the flat cable 100, and ensuring the performance of the flat cable 100.

Further, an interval between any two adjacent flat wires 110 is equal. The interval between any two adjacent flat wires 110 is preferably 0.5 mm, thereby simplifying the processing process. It is also possible to appropriately increase the interval between the signal line 112 and the power line 111 and between the signal line 112 and the ground line 113, thereby reducing interference to signal transmission.

To ensure the normal function and safety of the flat cable 100 connecting modules, the length of the flat cable 100 is less than 1.5 meters.

In addition, this application further provides a WIFI connection line 400, and the WIFI connection line 400 includes the flat cable 100 as described above. The ground lines 113 arranged near the edges of the flat cable 100 are configured to connect the ground line of the power supply. The power line 111 in the middle is configured for power transmission. The remaining four signal lines 112 are respectively configured to transmit USB D−/D+ signals and general enable control signals. Because the cross-sectional areas of the power line 111 and the ground line 113 have been greatly increased compared to before, when the WIFI module is working under the same conditions, the voltage drop on the power line 111 and the ground line will not drop too much, and the WIFI module may work normally.

One end of the flat cable 100 is provided with a first connector 200 configured to be connected to a TV motherboard, and the other end of the flat cable 100 is provided with a second connector 300 configured to be connected to a WIFI module. The first connector 200 is provided with first connection terminals 210, and the second connector 300 is provided with second connection terminals 310, where the first connection terminals 210 and the second connection terminals 310 are arranged in a one-to-one correspondence and conducted through corresponding flat wires 110. The first connector 200 and the second connector 300 of the WIFI connection line 400 are conducted through the flat wires 110. The first connection terminals 210 on the first connector 200 is configured to connect to the corresponding port on the TV motherboard, and the second connection terminals 310 on the second connector 300 is configured to connect to the corresponding port on the WIFI module. By providing the first connector 200 and the second connector 300, the WIFI connection line 400 may be in detachable plug connection with the TV motherboard and the WIFI module, thereby simplifying the assembly process, and ensuring a stable connection and facilitating future maintenance.

A number of the second connection terminals 310 on the second connector 300 is preferably 9, and the 9 connection terminals are respectively two ground terminals for connecting with the ground line, two signal terminals for transmitting the D− and D+ signals of the USB, two control terminals configured to transmit enable control signals, and three power terminals configured to transmit power. Even though the specifications of the flat wires 110 in the flat cable 100 are changed, the number of the first connection terminals 210 and the second connection terminals 310 remains unchanged, that is, the ports of the WIFI connection line 400 which are connected with the first connection terminals 210 and the second connection terminals 310 do not need to be redesigned, and are compatible with traditional models, so that the WIFI connection line 400 may be used for replacement when the traditional models are repaired.

In the above-mentioned preferred embodiment, the second connection terminals 310 are arranged corresponding to the flat wires 110, and the second connection terminals 310 are respectively a first ground terminal 311, a second ground terminal 319, a first power terminal 314, a second power terminal 315, a third power terminal 316, a first signal terminal 312, a second signal terminal 313, a first control terminal 317, and a second control terminal 318; and the first power terminal 314, the second power terminal 315 and the third power terminal 316 share the power line 111. The first ground terminal 311 and the second ground terminal 319 are each connected to a ground line 113. The first signal terminal 312, the second signal terminal 313, the first control terminal 317, and the second control terminal 318 are each connected to a signal line 112. The first power terminal 314, the second power terminal 315 and the third power terminal 316 are all connected to the power line 111. Since the flat cable 100 has no directionality, only the flat cable 100, the first connector 200 and the second connector 300 need to be manufactured separately in the manufacture of the WIFI connection line 400, and then the flat cable 110 and the corresponding first connection terminals 210 and the second connection terminals 310 are firmly connected to ensure electrical connection.

Optionally, the first ground terminal 311, the first signal terminal 312, the first control terminal 317, the first power terminal 314, the second power terminal 315, the third power terminal 316, the second control terminal 318, the second signal terminal 313, and the second ground terminal 319 are sequentially arranged at intervals along a width direction of the second connector 300. The arrangement sequence of the first connection terminals 210 and the second connection terminals 310 is consistent with the arrangement sequence of the flat wires 110, forming a symmetrical arrangement structure, so that the WIFI connection line 400 in this embodiment has no directionality. No matter which end of the WIFI connection line 400 is inserted into the corresponding socket, the connection relationship is the same, and there is no need to consider the problem of direction.

The above are only the preferred embodiments of this application, and therefore do not limit the patent scope of this application. Under the conception of this application, any equivalent structural transformation made by using the content of the description and drawings of this application, or direct/indirect application in other related technical fields are all included in the patent protection scope of this application.

What is claimed is:

1. A flat cable, comprising a plurality of flat wires and an insulation layer wrapped around the flat wires, wherein the flat wires comprise one power line, four signal lines and two ground lines arranged at intervals, the power line is arranged in a center of the flat cable, two of the signal lines and one of the ground lines are sequentially arranged along a direction from the power line to two edges of the flat cable, and a width of the power line and a width of each ground line are both greater than a width of each signal line.

2. The flat cable of claim 1, wherein the width of the power line is same as the width of each ground line and is 1.3 mm.

3. The flat cable of claim 1, wherein the width of each signal line is 0.3 mm.

4. The flat cable of claim 1, wherein an interval between any two adjacent flat wires is equal.

5. The flat cable of claim 1, wherein a length of the flat cable is less than 1.5 meters.

6. A WIFI connection line, comprising a flat cable, wherein the flat cable comprises a plurality of flat wires and an insulation layer wrapped around the flat wires, the flat wires comprise one power line, four signal lines, and two ground lines arranged at intervals, the power line is arranged in a center of the flat cable, two of the signal lines and one of the ground lines are sequentially arranged along a direction from the power line to two edges of the flat cable, and a width of the power line and a width of each ground line are both greater than a width of each signal line.

7. The WIFI connection line of claim 6, wherein one end of the flat cable is provided with a first connector configured to be connected to a TV motherboard, and the other end of the flat cable is provided with a second connector configured to be connected to a WIFI module; the first connector is provided with first connection terminals, and the second connector is provided with second connection terminals, wherein the first connection terminals and the second connection terminals are arranged in a one-to-one correspondence and are conducted through corresponding flat wires.

8. The WIFI connection line of claim 7, wherein the second connection terminals are arranged corresponding to the flat wires, and the second connection terminals are respectively a first ground terminal, a second ground terminal, a first power terminal, a second power terminal, a third power terminal, a first signal terminal, a second signal terminal, a first control terminal, and a second control terminal and the power line is shared by the first power terminal, the second power terminal, and the third power terminal.

9. The WIFI connection line of claim 8, wherein the first ground terminal, the first signal terminal, the first control terminal, the first power terminal, the second power terminal, the third power terminal, the second control terminal, the second signal terminal, and the second ground terminal are sequentially arranged at intervals along a width direction of the second connector.

10. The WIFI connection line of claim 6, wherein the width of the power line is same as the width of each ground line and is 1.3 mm.

11. The WIFI connection line of claim 6, wherein the width of each signal line is 0.3 mm.

12. The WIFI connection line of claim 6, wherein an interval between any two adjacent flat wires is equal.

13. The WIFI connection line of claim 6, wherein a length of the flat cable is less than 1.5 meters.

* * * * *